United States Patent [19]

Zakora

[11] 4,242,058

[45] Dec. 30, 1980

[54] DOSAGE PUMP

[75] Inventor: Miloslav Zakora, Hillerød, Denmark

[73] Assignee: A/S N. Foss Electric, Hillerød, Denmark

[21] Appl. No.: 23,289

[22] Filed: Mar. 23, 1979

[30] Foreign Application Priority Data

Mar. 28, 1978 [DK] Denmark ..... 1363/78

[51] Int. Cl.[3] ..... F04B 23/00

[52] U.S. Cl. ..... 414/437; 222/383; 222/409

[58] Field of Search ..... 417/538, 437, 440, 487, 417/486; 222/383, 385, 387, 409; 366/267, 268, 269, 262

[56] References Cited

U.S. PATENT DOCUMENTS

| | | | |
|---|---|---|---|
| 1,181,837 | 5/1916 | Campbell | 222/383 |
| 1,188,097 | 6/1916 | Pearsons | 222/385 |
| 2,140,679 | 12/1938 | McKeever | 222/385 |
| 2,995,451 | 8/1961 | Leach | 366/267 |

FOREIGN PATENT DOCUMENTS

| | | |
|---|---|---|
| 327098 | 8/1970 | Sweden . |
| 369096 | 8/1974 | Sweden . |

*Primary Examiner*—Robert W. Jenkins

*Attorney, Agent, or Firm*—Dennison, Meserole, Pollack & Scheiner

[57] ABSTRACT

A manually operatable dosage pump comprising a cylinder, a piston movable therein between two end positions, and inlet and outlet passages communicating with the cylinder space and each containing a one-way valve or check valve. The piston is adapted to interrupt communication between said inlet and outlet passages in at least one of the end positions of the piston. Thus, a valve member mounted on the piston may cooperate with valve seats formed in a valve chamber axially aligned with the cylinder space.

4 Claims, 3 Drawing Figures

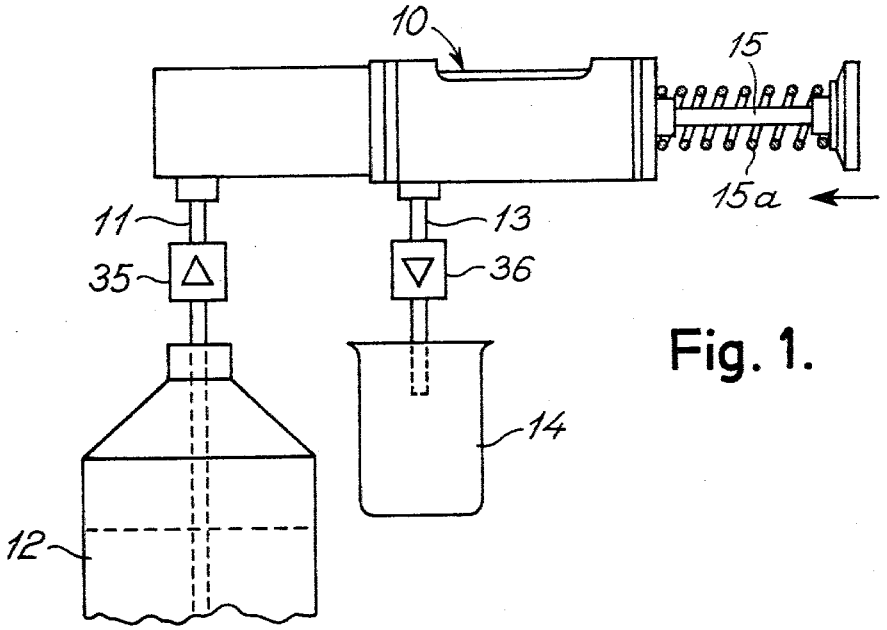
Fig. 1.
Fig. 2.
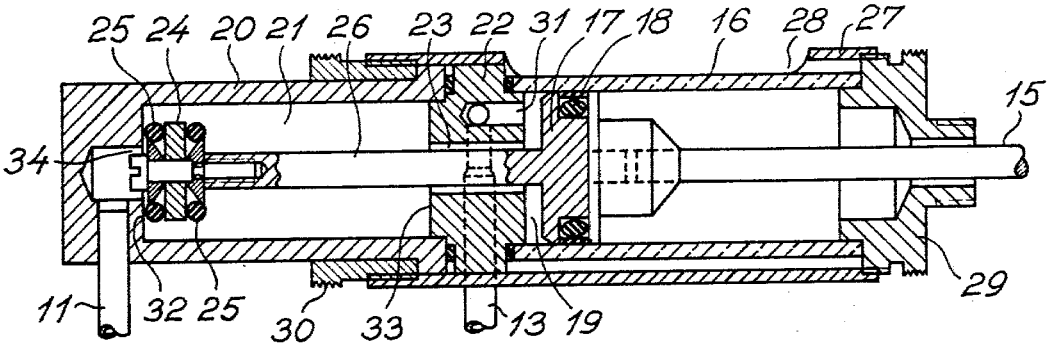
Fig. 3.
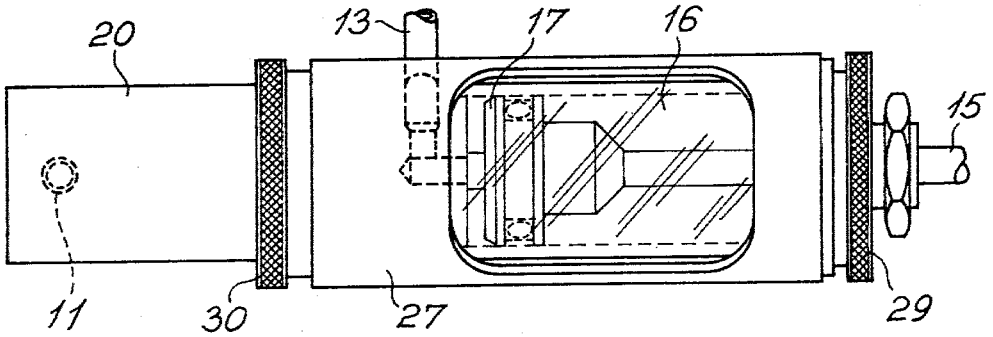

DOSAGE PUMP

BACKGROUND OF THE INVENTION

1. Field of the Invention

The present invention relates to a dosage pump of the type having a piston sealingly engaging with the inner surface of the cylinder and movable between a first position or top position and a second position or bottom position, the volume defined in the cylinder by the piston communicating with inlet and outlet passages. If a one-way valve or check valve is provided in each of said inlet and outlet passages or in conduits communicating therewith, and the inlet passage is connected to a liquid container or another liquid source, movement of the piston between its first and second positions within the cylinder results in discharge of metered or dosed amounts of liquid from the liquid container through the outlet passage of the pump.

2. Description of the Prior Art

It is known to use dosage pumps of this type in connection with for example liquid analyzing apparatuses such as blood or milk analyzing apparatuses, for passing metered or dosed amounts of liquid samples into the apparatus. A liquid analyzer provided with such dosage pump is disclosed in U.S. patent application Ser. No. 894,389.

It has been found that results obtained by analyzing a number of identical liquid samples in such liquid analyzing apparatus provided with a manually operated dosage pump of the above type quite often differ to an unacceptable degree, and this is especially true when the dosage pump is operated by different persons.

SUMMARY OF THE INVENTION

The one-way valves used in the inlet and outlet passages or in the conduits connected thereto normally comprise a spring biased valve member, and it has now been found that the differing measuring results mentioned above are primarily caused by the fact that the function of the said one-way valves is dependent on the driving force applied to the piston of the dosage pump and, consequently, by the person operating the pump. When the piston of the pump is moved from its said second position to said first position or from its bottom position to its top position the one-way valve controlling the inlet passage will be closed while the one-way valve controlling the outlet passage will be open. Thus, a moving liquid column is provided within the outlet passage and at the end of the pressure stroke the inertia of the moving liquid column may generate such suction effect at the one-way valve in the inlet passage that this valve is opened more or less which gives rise to suction of a certain amount of "false liquid" into the pump, and this amount of liquid will depend on the velocity of the moving liquid column in the outlet passage, i.e. of the pressure applied to the piston of the dosage pump by the operator.

Similarly, when the piston of the dosage pump is moved from its top position to its bottom position during its suction stroke the one-way valve associated with the inlet passage will be open while the one-way valve associated with the outlet passage will be closed. When the piston stops at the end of its suction stroke the inertia of the liquid column caused to move through the inlet passage into the cylinder may generate such an overpressure in the cylinder and, consequently, also at the one-way valve associated with the outlet passage that this valve tends to open more or less so that a small amount of liquid leaks through the valve before the pump or pressure stroke of the piston is initiated.

In practise the phenomena described above causes only rather small variations in the metered amounts of liquid discharged by a dosage pump of the above known type. However, these variations may, nevertheless, give rise to unacceptable errors in measurement.

The present invention provides a dosage pump of the above type by means of which it is possible to obtain an improved metering accuracy.

The present invention provides a dosage pump comprising a housing including a cylinder, a piston sealingly engaging with the inner surface of the cylinder and movable between a first position in which the piston defines a first volume in said housing, and a second position in which the piston defines a second greater volume in the housing, inlet and outlet passages communicating with said first and second volumes in the housing, and means arranged on said piston and adapted to interrupt in at least one of said first and second positions of the piston the communication established between said inlet and outlet passages by said first and second volumes. Such interruption of the communication between the inlet and outlet passages in said first and/or second position of the piston prevents that the function of one-way valves arranged in the inlet and outlet passages or conduits connected therewith is adversely affected by the inertia of moving liquid columns in the said passages or conduits as described above.

The piston may interrupt the communication between the inlet and outlet passages in any suitable manner. If a one-way valve controlling the inlet or outlet passage is arranged within the housing or cylinder of the pump the piston or an actuating member mounted thereon may be adapted to directly engage with the valve member of the one-way valve so as to press that valve member against its seat in the said first or top position of the piston. Alternatively, the dosage pump may comprise a valve seat defined around at least one of said inlet and outlet passages at the position where said passage opens into said first volume, said means arranged on said piston including a valve member for sealingly engaging with said valve seat in said first position of the piston. Thus, in the latter embodiment the flow of liquid through the inlet and outlet passages is controlled not only by the one-way valves associated with these passages, but also by an additional valve closing the connection between the inlet and outlet passages in the said first position or top position of the piston, whereby the adverse influence of inertia forces on the one-way valve in the inlet passage is avoided.

In a preferred embodiment of the dosage pump according to the invention the said housing contains a valve chamber communicating with said cylinder and having spaced first and second valve seats defining valve openings, said inlet and outlet passages communicating through said valve chamber and valve openings, a valve member connected to said piston and arranged within said valve chamber so as to engage with said first and second valve seats in the first and second positions of the piston, respectively. By this embodiment the communication between the inlet and outlet passages is interrupted in said first as well as in said second position of the piston.

The valve opening defined by said second valve seat may, preferably, interconnect said cylinder and said valve chamber, a connecting rod interconnecting said piston and said valve member extending through said valve opening. If for some reason or another bubbles of gas or air are introduced into the cylinder this may adversely affect the metering accuracy of the pump. In the last mentioned embodiment, however, such gas or air bubbles will collect at the position where the outlet passage opens into the cylinder and will consequently tend to be discharged through the outlet passage.

BRIEF DESCRIPTION OF THE DRAWINGS

The invention will now be further described with reference to the drawings, wherein FIG. 1 is a diagrammatic illustration of a manually operatable dosage pump according to the invention, FIG. 2 is a sectional view of the pump shown in FIG. 1 in an enlarged scale, and FIG. 3 is a side view of the pump shown in FIG. 2.

DESCRIPTION OF THE PREFERRED EMBODIMENT

FIG. 1 shows a dosage pump 10 having an inlet passage or inlet conduit 11 communicating with the inner space of a container or reservoir 12 containing a sample liquid or a sample liquid constituent. The pump 10 also includes an outlet passage or conduit 13 which may open into a sample container 14, and a manually operatable piston rod 15 which may be spring biased by a return spring 15*a*.

As shown in FIGS. 2 and 3 the pump 10 comprises a cylinder 16 which is preferably made from a transparent material such as glass and which contains a piston 17 mounted on the piston rod 15 and provided with an annular sealing member or sealing ring 18. A cylinder space 19 is defined within the cylinder 16 by the piston 17. A valve housing 20 mounted on the cylinder 16 and axially aligned therewith defines a valve chamber 21 interconnecting the inlet and outlet passages 11 and 13. A connecting block 22 having a central bore 23 is arranged between the cylinder 16 and the valve housing 20. A valve member 24 having an annular sealing member or sealing ring 25 at both sides is mounted at the free end of a connecting rod 26 extending through the central bore 23 so as to define an annular space between the connecting rod and the cylindrical wall of the bore.

The cylinder 16, the valve housing 20, and the connecting block 22 are connected together by means of an outer cylindrical jacket 27 which is preferably made from metal and provided with a cut-out 28. The jacket 27 cooperates with threaded sleeves 29 and 30 as shown in FIG. 2 so as to secure the parts 16, 20, and 22 together.

As shown in FIG. 2, the inlet passage 11 opens into the valve chamber 21 through the end wall of the valve housing 20 while the outlet passage 13 extends through the connecting block 22 and opens into the uppermost part of the cylinder space 19 through an opening 31 positioned opposite to the piston 17. The valve member 24 may cooperate with valve seats 32 and 33 located within the valve chamber 21 around the opening 34 of the inlet passage 11 and around the central bore 23 in the connecting block 22, respectively.

The dosage pump shown on the drawings functions as follows: It is supposed that the starting position of the piston 17 is "the bottom position" thereof, i.e. the position in which one of the sealing members 25 on the valve 24 tightly engages with the valve seat 33 surrounding the central bore 23 in the connecting block 22. The valve chamber 21 and the cylinder space 19 are now supposed to be filled with liquid from the liquid container 12. The inlet passage 11 and the outlet passage 13 each contain a one-way valve or a check valve 35 and 36, respectively, of which the valve 35 allows liquid flow only in the direction from the container 12 towards the valve chamber 21 while the one-way valve 36 allows liquid flow only in the direction from the cylinder space 19 towards the sample container 14. When the operator manually depresses the piston rod 15 in the direction of the arrow shown in FIG. 1 against the bias of the spring 15*a* the one-way valve 35 will close automatically while the one-way valve 36 will open so that liquid is discharged from the cylinder space 19 through the opening 31 and the outlet passage 13 into the sample container 14. The pressure or discharge stroke of the piston continues till the valve member 24 comes into engagement with the valve seat 32 and closes the opening 34 of the inlet passage 11. When the piston 17 has reached this innermost or top position and the piston movement is stopped the liquid column in the outlet passage 13 tends to continue its movement due to its inertia whereby a suction is created in the cylinder space 19 and the valve chamber 21. However, as the opening 34 of the inlet passage 11 is closed by the valve member 24 this suction or vacuum cannot be transmitted to the one-way valve or check valve 35 of the inlet passage 11. The piston rod 15 may now manually or under the influence of the bias of the spring 15*a* be returned to its starting position or bottom position. The one-way valve or check valve 36 of the outlet passage 13 will then automatically close while the one-way valve 35 of the inlet passage 11 will open so that liquid is sucked from the container 12 into the valve chamber 21 and further through the bore 23 in the connecting block 22 into the cylinder space 19. The piston 17 is stopped in its starting or bottom position when the valve member 24 comes into engagement with the valve seat 33 surrounding the central bore 23 in the connecting block 22. When the movement of the piston 17 is stopped the liquid column within the inlet passage 11 will tend to continue its movement due to inertia whereby a certain overpressure is created within the valve chamber 21. This overpressure cannot, however, be transmitted to the cylinder space 19 and further to the one-way valve 36 within the outlet passage 13 because the central bore 23 in the connecting block 22 is closed by the valve member 24.

If for some reason or another—for example because the liquid container 12 does not contain a sufficient amount of liquid—air or gas bubbles are introduced into the cylinder space 19, such air or gas will collect at the opening 31 of the outlet passage 13. Therefore, such air or gas bubbles will most likely be discharged through the outlet passage 13 during the next following full pressure stroke of the piston.

It should be understood that several changes and modifications may be made in the embodiment shown in the drawings. As an example the inlet passage 11 and the outlet passage 13 may right away be changed. It is also possible to avoid the valve chamber 21, and the inlet and outlet passages may then open into the end wall of the cylinder space 19 so that the piston 17 may function as a valve member directly cooperating with at least one valve seat formed around the opening of the inlet and/or outlet passages. Furthermore, the valve member 24 may be mounted resiliently in relation to the piston 17 provided that fixed end positions of the piston movement are defined in some way or another, for example by abutment surfaces provided within the cylinder 16.

I claim:

1. A dosage pump comprising:

a housing including a cylinder, said housing containing a valve chamber communicating with said cylinder and having spaced first and second valve seats defining valve openings;

a piston sealingly engaging with the inner surface of the cylinder and movable between a first position in which the piston defines a first volume in said housing, and a second position in which the piston defines a second greater volume in the housing;

a valve member connected to said piston and arranged within said valve chamber so as to engage with said first and second valve seats in the first and second positions of the piston, respectively;

inlet and outlet passages communicating through said valve chamber and valve openings with said first and second volumes in the housing;

means arranged on said piston and adapted to interrupt in at least one of said first and second positions of the said piston, the communication established between said inlet and outlet passages by said first and second volumes, said means on said piston including a valve member for sealingly engaging with said valve seat in said first position of the piston.

2. A dosage pump according to claim 1, wherein said cylinder and said valve chamber are interconnected through the valve opening defined by said second valve seat, said piston and said valve member being interconnected by a connecting rod extending through said valve opening.

3. A dosage pump according to claim 2, wherein said outlet passage opens into the cylinder at a position opposite to said piston.

4. A dosage pump according to claim 3, wherein said valve member is rigidly connected to the piston, said first and second positions of the piston being determined by the engagement between said valve member and said first and second valve seats, respectively.

* * * * *